US007296701B2

(12) United States Patent
Ozawa et al.

(10) Patent No.: US 7,296,701 B2
(45) Date of Patent: Nov. 20, 2007

(54) BOTTLE-SHAPED SYNTHETIC RESIN CONTAINER

(75) Inventors: Tomoyuki Ozawa, Koto-ku (JP); Takao Iizuka, Koto-ku (JP); Shoji Tanabe, Koto-ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 10/546,975

(22) PCT Filed: Feb. 27, 2004

(86) PCT No.: PCT/JP2004/002338

§ 371 (c)(1),
(2), (4) Date: May 1, 2006

(87) PCT Pub. No.: WO2004/076298

PCT Pub. Date: Sep. 10, 2004

(65) Prior Publication Data

US 2006/0289379 A1 Dec. 28, 2006

(30) Foreign Application Priority Data

Feb. 28, 2003 (JP) ..... 2003-054559

(51) Int. Cl.
*B65D 1/42* (2006.01)
*B65D 1/02* (2006.01)
*B65D 23/02* (2006.01)

(52) U.S. Cl. ..... 215/381; 215/382; 215/383; 215/900; 220/666; 220/669; 220/671; 220/675

(58) Field of Classification Search ..... 215/381–384, 215/900, 379; 220/609, 666, 669, 671, 675
See application file for complete search history.

(56) References Cited

U.S. PATENT DOCUMENTS

| | | | | |
|---|---|---|---|---|
| 3,225,950 | A * | 12/1965 | Fulcher et al. | 215/384 |
| 5,067,622 | A * | 11/1991 | Garver et al. | 215/381 |
| 6,112,925 | A * | 9/2000 | Nahill et al. | 215/382 |
| 6,296,131 | B2 * | 10/2001 | Rashid | 215/383 |
| 6,497,333 | B1 * | 12/2002 | Ellis et al. | 215/383 |

FOREIGN PATENT DOCUMENTS

| | | |
|---|---|---|
| JP | U 2-129014 | 10/1990 |
| JP | A 8-230855 | 9/1996 |
| JP | A 9-193918 | 7/1997 |
| JP | A 9-272523 | 10/1997 |

* cited by examiner

*Primary Examiner*—Sue A. Weaver
(74) *Attorney, Agent, or Firm*—Oliff & Berridge, PLC

(57) ABSTRACT

A bottle-shaped synthetic resin container (1) includes a body portion (3), and a circumferential groove (10) extending along an outer surface of the body portion (3). The circumferential groove (10) is defined by a groove bottom wall (11) and groove side walls (12*a*, 12*b*) extending from the groove bottom (11) to the outer surface of the body portion (3). At least one of the groove side walls (12*a*, 12*b*) extends substantially linearly, as seen in a longitudinal-sectional plane including a center axis (A) of the body portion (3), and forms an angle (α, β) of not more than 20° relative to a reference line (L) perpendicular to the center axis (A) of the body portion (3) in the longitudinal-sectional plane of the container (1).

1 Claim, 6 Drawing Sheets

BOTTLE-SHAPED SYNTHETIC RESIN CONTAINER

BACKGROUND ART

1. Technical Field

The present invention relates to a bottle-shaped synthetic resin container having a circumferential groove extending along the surface of the container body portion.

2. Prior Art

Generally, bottle-shaped container comprised of a synthetic resin such as polyethyleneterephthalate ("PET") has a reduced thickness of the body portion. As such, the appearance tends to deteriorate due to the deformation of the body portion into elliptical shape upon internal pressure reduction of the container, besides that the self-standing stability of the container tends to be lowered as a result of deformation of the container. In these respects, as compared to bottle-shaped containers made of glass, aluminum or the like, bottle-shaped synthetic resin container still has a room for further improvement in terms of its applicability to a filling line wherein the containers are transferred by gliding them along the bottom surface, or to an automatic vending machine capable of storing and dispensing a number of bottles.

In order to eliminate these problems, there is known a technology wherein the body portion of the bottle-shaped synthetic resin container has an outer surface formed with one or more circumferential grooves, which are utilized for allowing a contractive deformation of the bottle in the longitudinal direction of the bottle, so as to enhance the pressure reduction absorption property against the internal pressure reduction of the container, and thereby compensate for the pressure reduction resistance and the buckling strength. For example, Japanese Unexamined Patent Publication JP-09-272523 A1 discloses a bottle-shaped synthetic resin container wherein the groove bottom portions of the circumferential groove are arranged into a polygonal shape as seen in a plane perpendicular to the center axis of the container. However, in this instance, the corners of the polygon formed by relatively narrow groove bottom portions function as beams, which not only impede the contractive deformation of the container in the longitudinal direction of the bottle by utilizing the groove portions, but also require a relatively strict manufacturing control upon blow molding or the like.

Accordingly, there is a need for an improved synthetic resin bottle, which does not require a strict manufacturing control, which is formed in the outer surface of the body portion with a circumferential groove of more simplified shape, and which yet effectively suppresses elliptical deformation of the bottle body portion due to the internal pressure reduction of the container, thereby sufficiently exhibiting the required pressure reduction resistance or buckling strength.

DISCLOSURE OF THE INVENTION

It is therefore an object of the present invention to provide a bottle-shaped synthetic resin container satisfying the above-mentioned need.

To achieve such an object, according to the present invention, there is provided a bottle-shaped synthetic resin container comprising a body portion, and a circumferential groove extending along an outer surface of the body portion, said circumferential groove being defined by a groove bottom wall and groove side walls extending from the groove bottom to the outer surface of the body portion, wherein at least one of the groove side walls extends substantially linearly, as seen in a longitudinal-sectional plane including a center axis of the body portion, and forms an angle within a range from 0° to not more than 20° relative to a reference line that is perpendicular to the center axis in said longitudinal-sectional plane.

With the above-mentioned structure according to the present invention, although the circumferential groove has a simple shape that can be realized by a relatively easy manufacturing control, it is yet possible to fully utilize the circumferential groove, upon the internal pressure reduction due to a cooling after hot filling, etc., so as to cause a smooth contractive deformation of the container in its center axis direction. Moreover, even when the contractive deformation proceeds considerably, there is established a state wherein the upper and lower edges of the circumferential groove are brought into contact with each other so as to prevent a further lowering of the buckling strength from such a state, thereby making it possible to suppress an elliptical deformation of the body portion, to preserve a required buckling strength, and to improve the pressure reduction resistance.

According to the present invention, when the both groove side walls of the circumferential groove are arranged opposite to each other and extend substantially linearly in the longitudinal-sectional plane, it is preferred that the sum of the angles formed by the groove side walls relative to the reference line is not more than 30°.

According to the present invention, furthermore, it is preferred that the circumferential groove has a groove width which is smaller than the groove depth.

BRIEF DESCRIPTION OF THE DRAWINGS

The present invention will be further explained below with reference to the drawings.

BEST MODE FOR CARRYING OUT THE INVENTION

Figure 1:
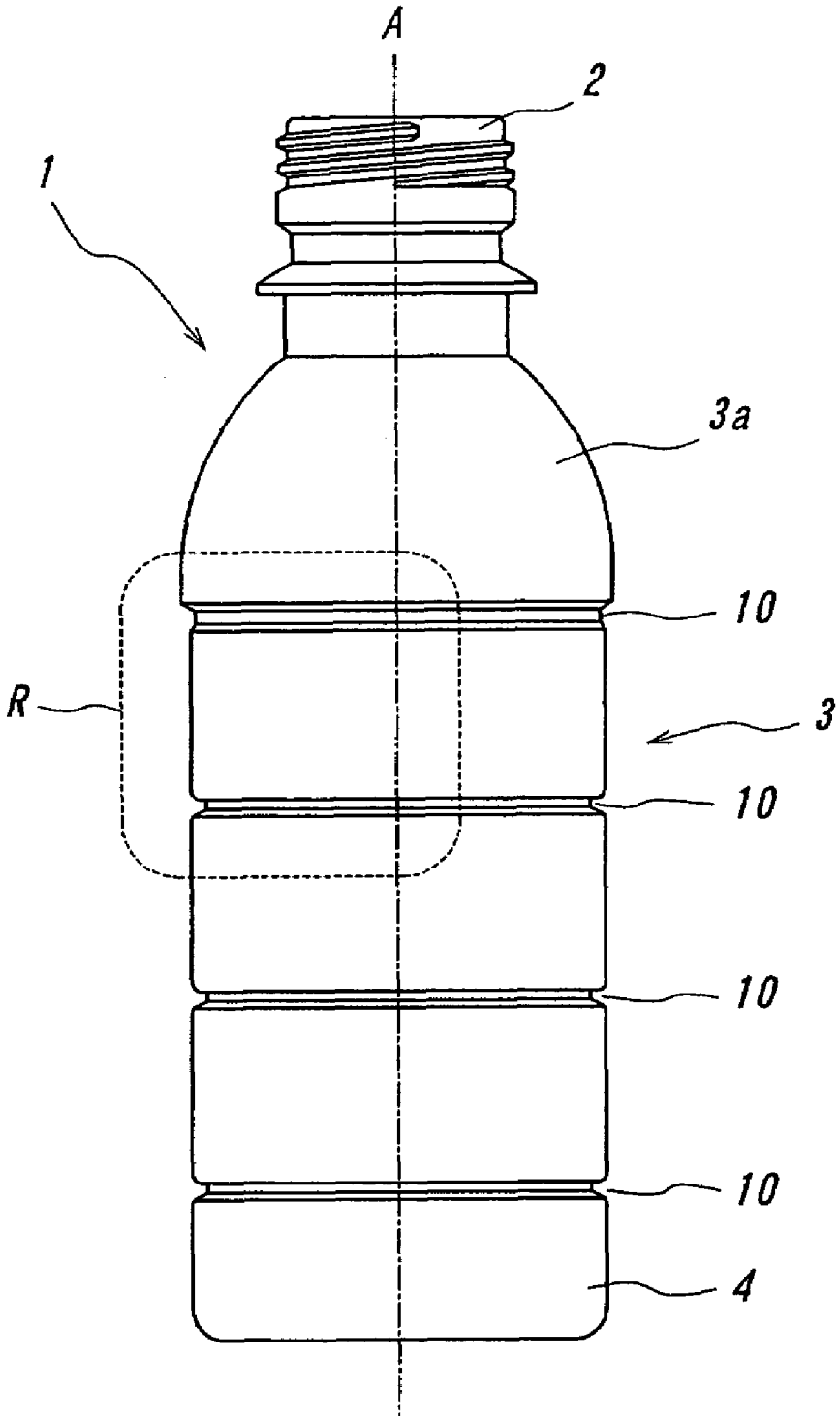
FIG. 1 is a front view of the PET bottle according to one embodiment of the present invention.

Referring to FIG. 1, there is shown one embodiment of the present invention that is directed to a bottle-shaped container made of polyethylene-terephthalate ("PET bottle"), and denoted as a whole by reference numeral 1. The PET bottle 1 includes a mouth portion 2, a body portion 3 and a bottom portion 4, which are arranged in the stated sequence, and can be maintained in a self-supporting state with its bottom portion 4 placed on a supporting surface, not shown. The body portion 3 has a shoulder portion 3*a* at its junction with the mouth portion 2, and is formed with four circumferential grooves 10 extending along the outer surface of the body portion 3 in its circumferential direction. In the illustrated embodiment, these circumferential grooves 10 are arranged in planes perpendicularly intersecting the center axis A of the bottle 1 or the body portion 3. The body portion 3 as a whole has a substantially cylindrical body wall.

Figure 2A:
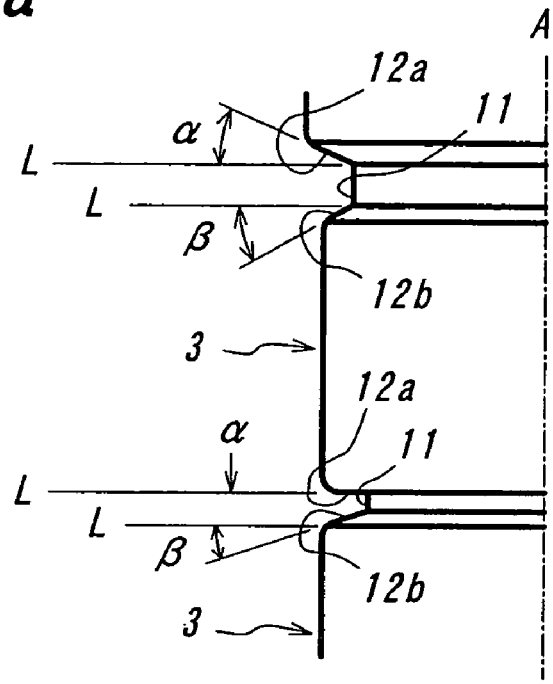
FIGS. 2(*a*) and (*b*) are enlarged views showing a region R in FIG. 1, respectively.
Figure 2B:
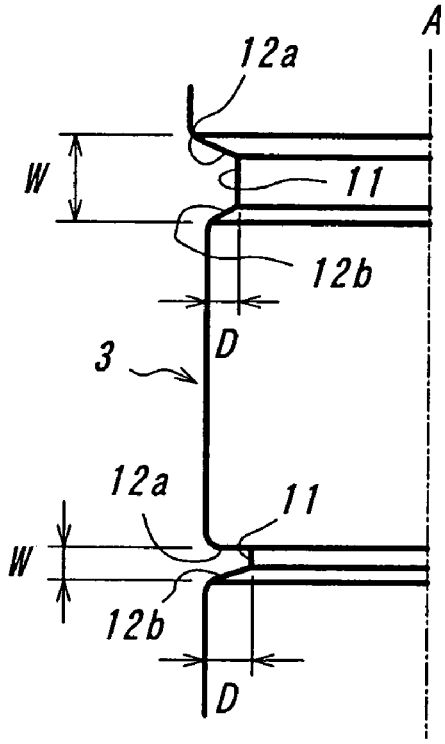

In the illustrated embodiment, as particularly shown in FIGS. 2(*a*) and 2(*b*), each circumferential groove 10 includes a groove bottom wall 11, a groove side wall 12*a* extending from the groove bottom wall 11 to the outer surface region of the body portion 3 (shoulder portion 3*a*) on the side of the mouth portion 2, and a groove side wall 12*b* extending from the groove bottom wall 11 to the outer surface region of the body portion 3 on the side of the bottom portion 4. The groove bottom wall 11 defines a substantially circular contour shape as seen in a cross-sectional plane of the bottle 1, perpendicularly intersecting the center axis A. As shown in FIG. 2(*a*), the groove side walls 12*a*, 12*b* extend substantially linearly with predetermined angles α, β relative to reference lines L perpendicularly intersecting the center axis A of the bottle 1 in a longitudinal-sectional plane of the bottle 1, which includes the center axis A, wherein the angles α, β are within a range from 0° to 20°, respectively.

Thus, the circumferential groove 10 shown on the upper side in FIG. 2(*a*) has opposite groove side walls 12*a*, 12*b* which form predetermined angles α ($0°<\alpha\leqq 20°$) and β ($0°<\beta\leqq 20°$) relative to the reference lines L, respectively. On the other hand, the circumferential groove 10 shown on the lower side in FIG. 2(*a*) has an upper groove side wall 12*a* in parallel to the reference line L ($\beta=0°$), and a lower groove side wall 12*b* which is inclined relative to the reference line L ($\beta>0°$). Furthermore, although not shown in the drawings, it is possible to arrange the both groove side walls 12*a*, 12*b* such that they extend in parallel to the respective reference lines L ($\alpha=0°$, $\beta=0°$).

In other words, as for the angles α, β formed by the groove side walls 12*a*, 12*b* of the circumferential grooves 10, it is sufficient that at least one of the following conditions are satisfied:

$$0°\leqq\alpha\leqq 20° \quad (1)$$

$$0°\leqq\beta\leqq 20° \quad (2)$$

With such an arrangement, although the circumferential groove 10 has a simple shape that can be realized by a relatively easy manufacturing control, it is yet possible to utilize the circumferential groove 10 upon the internal pressure reduction due to a cooling after a hot filling, etc., so as to cause a smooth contractive deformation of the bottle in its center axis direction. Moreover, even when the contractive deformation proceeds considerably, there is established a state wherein the upper and lower edges of the circumferential groove 10 are brought into contact with each other so as to prevent a further lowering of the buckling strength from such a state, thereby making it possible to suppress an elliptical deformation of the body portion 3, to preserve a required buckling strength and to improve the resistance to the pressure reduction.

As for the circumferential groove 10 extending along the outer surface of the body portion 3, in addition to the conditions (1) and (2) above, it is preferred that the sum of the angles α and β formed by the opposite groove side walls 12*a*, 12*b* relative to the reference lines is not more than 30°, as follows:

$$\alpha+\beta\leqq 30° \quad (3)$$

In this instance, it is more readily possible to induce a smooth contractive deformation in the longitudinal direction of the bottle by utilizing the circumferential grooves 10, so as to provide a further improved pressure reduction resistance of the body portion 3.

Also as for the circumferential groove 10, in addition to the conditions (1) and (2) above, or the conditions (1), (2) and (3) above, it is preferred that the groove width W is made smaller than the groove depth D as shown in FIG. 2(*b*), as follows:

$$W<D \quad (4)$$

When all of the conditions (1) to (4) are satisfied, it is even more readily possible to induce a smooth contractive deformation in the longitudinal direction of the bottle by utilizing the circumferential grooves 10, to provide a further improved pressure reduction resistance of the body portion 3.

Figure 3:
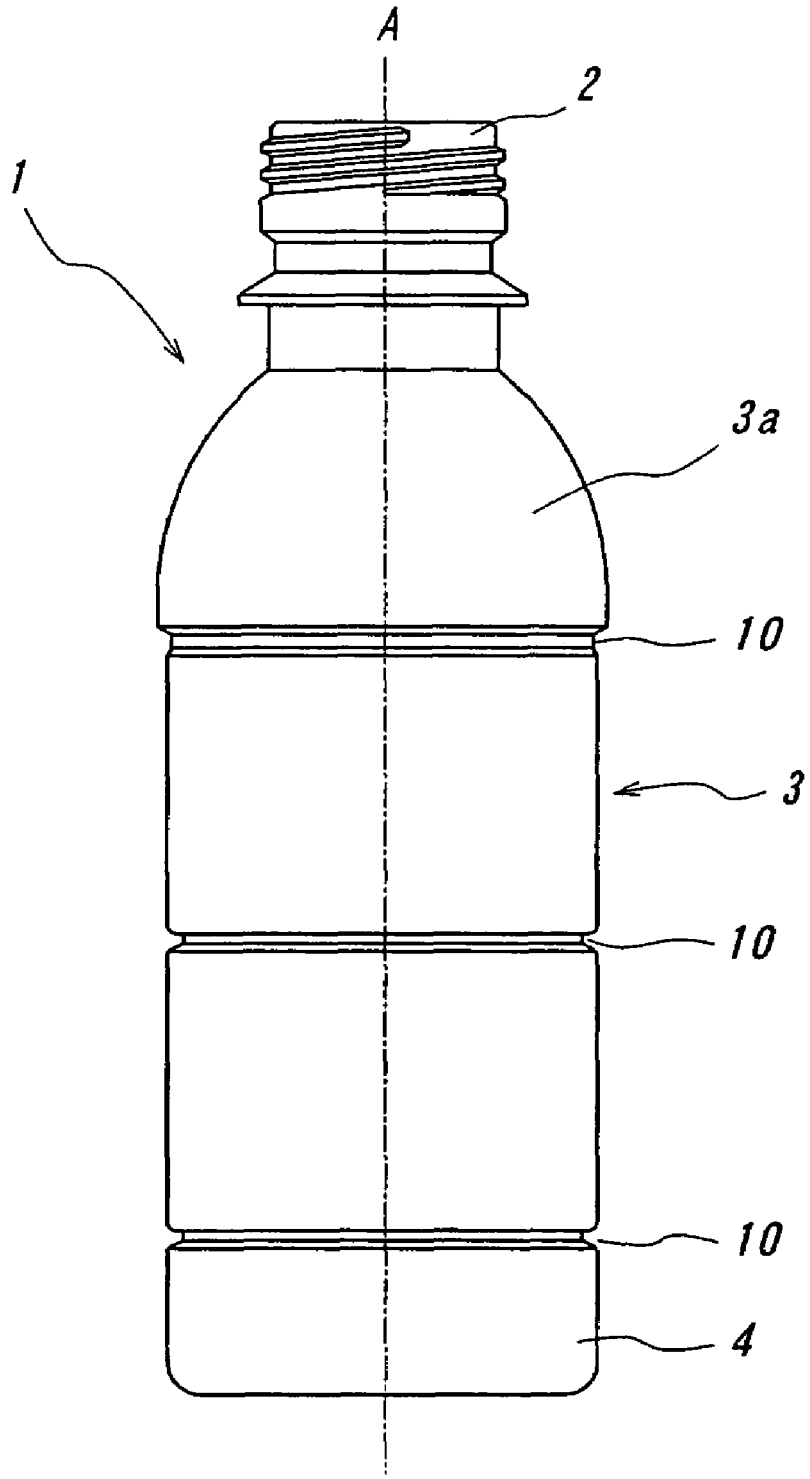
FIGS. 3 and 4 are front views showing the PET bottles according to further embodiments of the present invention, respectively.
Figure 4:
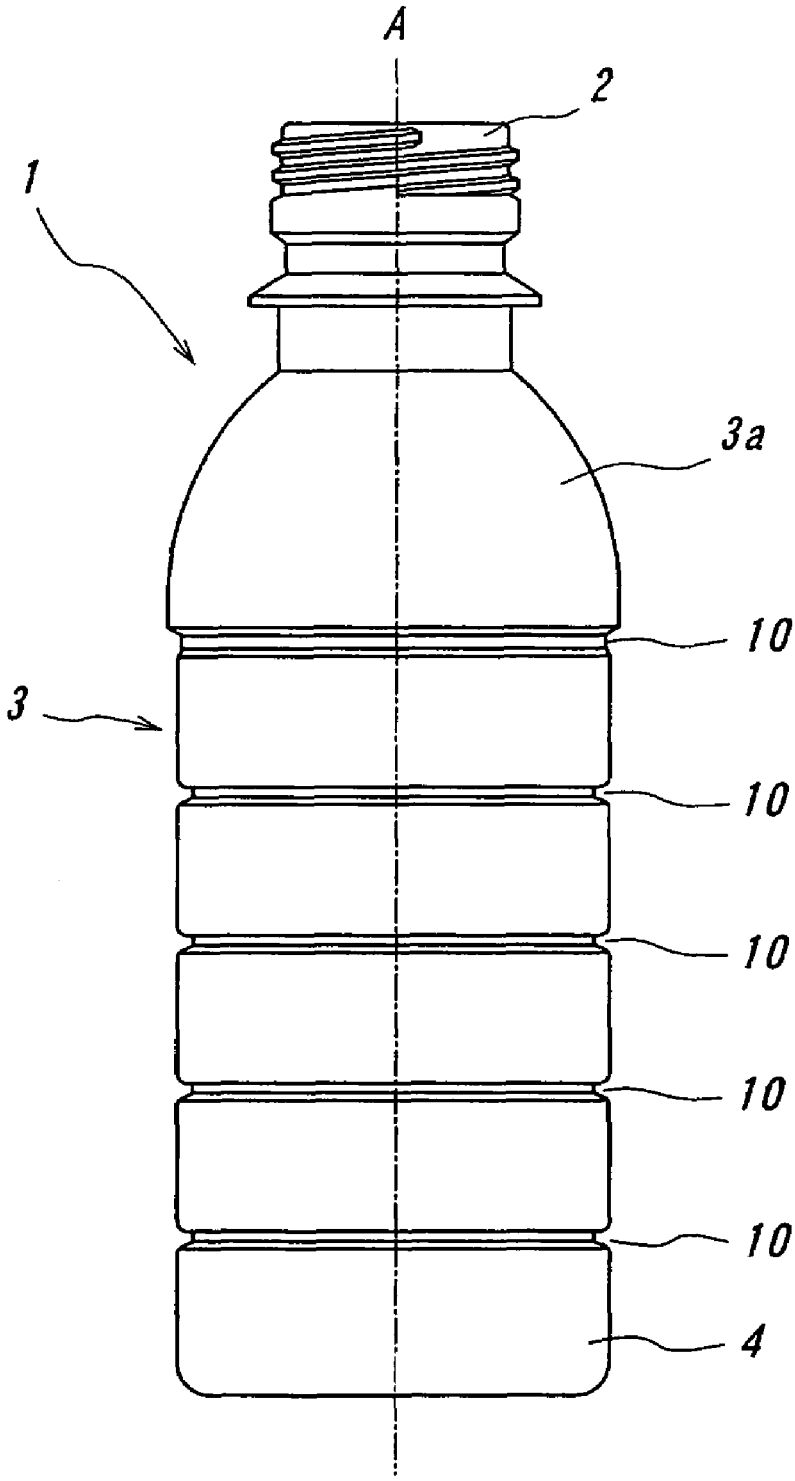
Figure 5:
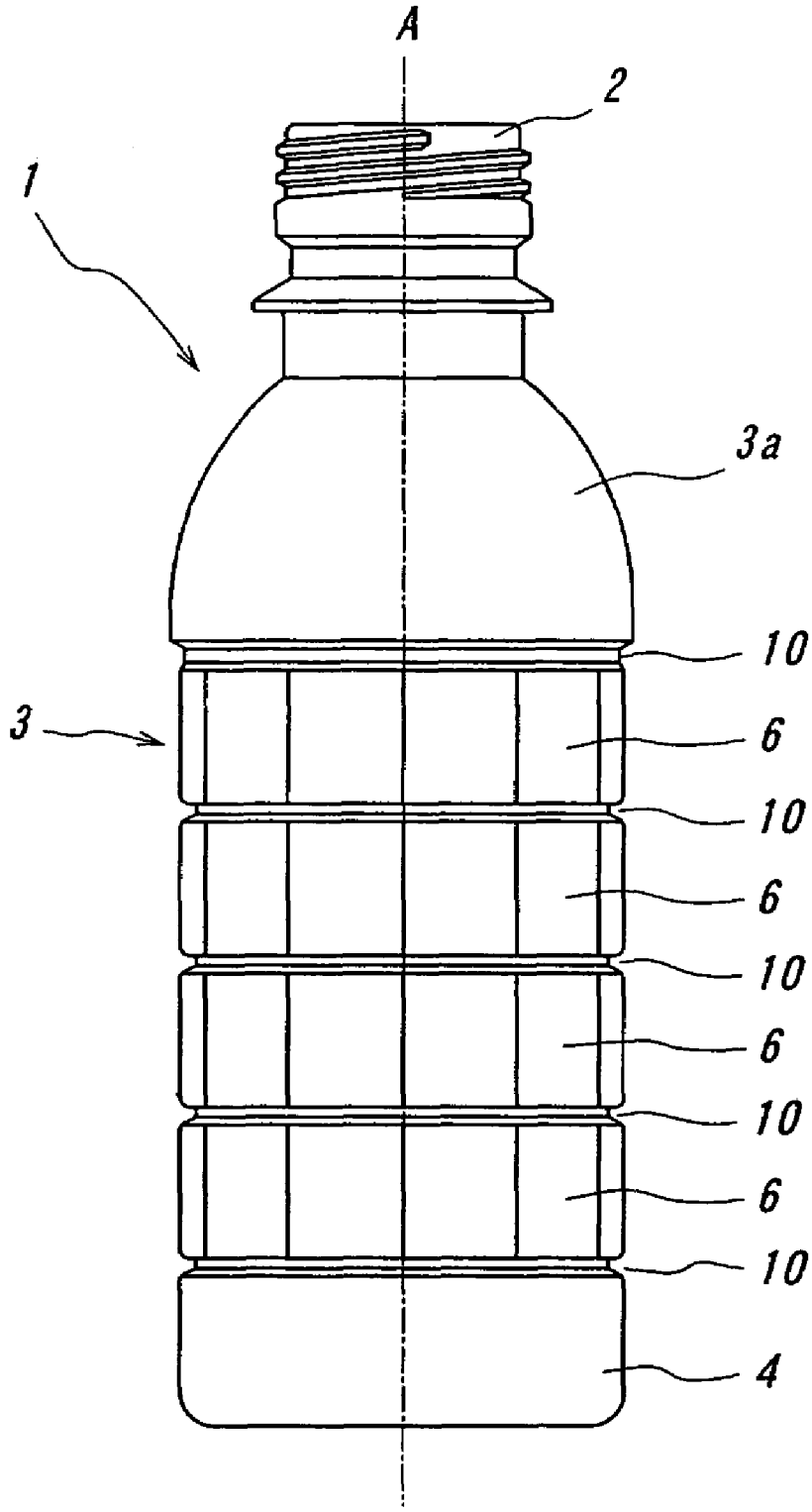
FIG. 5 is a front view showing a variation of the PET bottle of FIG. 4.

FIG. 3 shows another embodiment of the PET bottle 1 according to the present invention, wherein there are provided three circumferential grooves along the outer surface of the body portion. FIG. 4 shows a still further embodiment of the PET bottle 1 according to the present invention, wherein there are provided five circumferential grooves along the outer surface of the body portion. In the embodiments shown in FIGS. 3 and 4, the circumferential grooves 10 are arranged in planes perpendicularly intersecting the bottle center axis, and the body portion 3 as a whole has a body wall with a substantially circular cross-sectional shape. FIG. 5 shows a variation of the PET bottle 1 of FIG. 4, wherein the body portion 3 includes a body wall 6 with a polygonal cross-sectional shape, in a region between the circumferential grooves 10.

Experiments have been conducted to ascertain functions and effects of the present invention in terms of the resistance to the pressure reduction and the buckling strength. In these experiments, there were used test samples including the PET bottles 1 according to the embodiment of FIG. 1 and satisfying all the conditions (1) to (4) explained above, and similarly configured conventional PET bottles (control samples) which do not satisfy the conditions of the present invention. Each test sample has a bottle weight of 23 grams and an average thickness of 0.53 mm at the body portion (shoulder portion).

Figure 6:
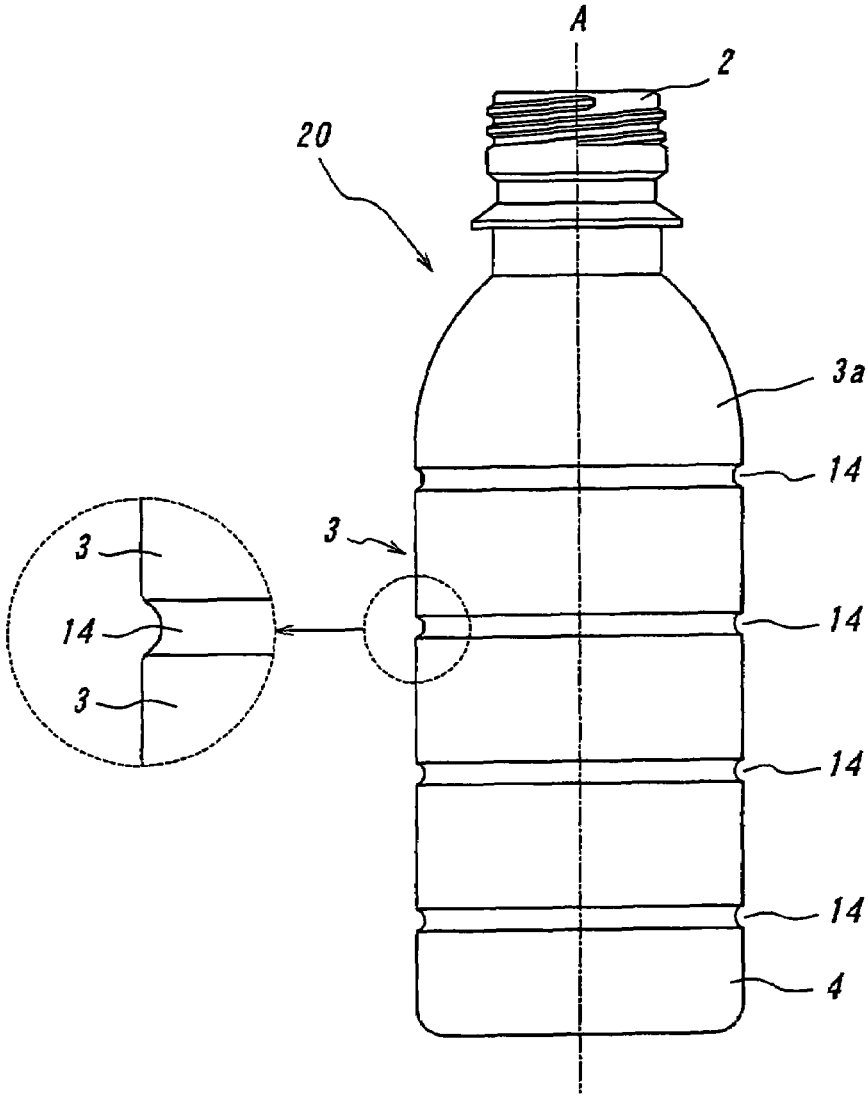
FIG. 6 RELATED ART
FIG. 6 is a front view showing the PET bottle according to a control example.

FIG. 6 is a front view of the PET bottle 20 as the control sample, wherein the elements that are the same as those shown in FIG. 1 are denoted by the same reference numerals to avoid a duplicative description. This PET bottle 20 has four circumferential grooves 14 extending along the outer surface of the body portion 3. Each circumferential groove 14 has a semi-circular cross-sectional shape so that the inner wall extends to the outer surface of the body portion 3 (shoulder portion 3*a*) with a curvature.

The pressure reduction resistance of these samples 1, 20 were measured and compared to each other. It has been revealed that the pressure reduction resistance of the PET bottle 1 according to the invention was approximately 709.1×133 Pa, whereas the pressure reduction resistance of the PET bottle 20 according to the control sample was approximately 952.0×133 Pa. This result clearly demonstrates that the present invention is superior in the pressure reduction resistance, as compared to the conventional structure. With respect to the PET bottle 1 according to the invention, it has been confirmed that even upon the internal pressure reduction after the filling of hot contents at a temperature ranging approximately from 70° C. to 100° C., a significant elliptical deformation of the bottle 1 does not occur, that the pressure reduction can be effectively absorbed solely by the contractive deformation of the bottle in the longitudinal direction by utilizing the circumferential grooves 10, and that the PET bottle 1 filled with the contents can be stably maintained in a self-standing state without causing buckling, thereby allowing a satisfactory application of the bottle to a filling line or an automatic vending machine. In contrast, it has been confirmed that the PET bottles 20 of the control samples cannot achieve such marked advantages.

Furthermore, by comparing the buckling strength of the above-mentioned test samples 1, 20, it has been revealed that the PET bottle 1 according to the invention provides a buckling strength of 51.2 kg, whereas the control sample of the PET bottles 20 provides a buckling strength of 55.5 kg. Although the present invention is slightly lower in the buckling strength as compared to the conventional structure, the buckling strength value achieved by the invention still ensures that the PET bottle 1 filled with the contents can be stably maintained in a self-standing state without causing buckling, thereby allowing a practical application to a filling line or an automatic vending machine.

It will be appreciated from the foregoing description that the present invention provides an improved synthetic resin bottle, which does not require a strict manufacturing control, which is formed in the outer surface of the body portion with a circumferential groove of less complicated shape, and which yet effectively suppresses elliptical deformation of the bottle body portion due to the internal pressure reduction of the container, thereby sufficiently exhibiting required pressure reduction resistance or buckling strength.

It is needless to mention that the present invention is not limited to the specific embodiments explained above, and various modifications may be made without departing from the scope of the invention as defined by the appended claims. Thus, for example, it is not necessary for al of the circumferential grooves extending along the outer surface of the body portion 3, to satisfy the specific conditions according to the present invention, and there may be included a circumferential groove of the conventional structure such as that shown in FIG. 6.

Furthermore, the circumferential groove 10 can be defined by angles $\alpha$ and $\beta$ relative to the reference lines L perpendicularly intersecting the center axis A of the bottle 1, and they are not limited to the grooves that are arranged in a plane perpendicularly intersecting the center axis A of the bottle, as in the illustrated embodiments. The circumferential grooves may be alternatively arranged in a plane intersecting the bottle center axis A at an angle other than 90 degrees, or embodied as wavy grooves undulating upwards and downwards along the bottle center axis A. Finally, the synthetic resin forming the bottle according to the present invention is not limited to polyethyleneterephthalate, allowing use of other suitable resin.

The invention claimed is:

1. A bottle-shaped synthetic resin container comprising a body portion, and a circumferential groove extending along an outer surface of the body portion, said circumferential groove being defined by a groove bottom wall and groove side walls extending from the groove bottom to the outer surface of the body portion, both groove side walls of said circumferential groove are arranged opposite to each other and extend substantially linearly in a longitudinal-sectional plane including a center axis of the body portion, said groove side walls forming angles relative to a reference line that is perpendicular to the center axis in said longitudinal-sectional plane, the sum of which is not more than 30°, and said circumferential groove has a groove width and a groove depth, said groove width being smaller than said groove depth, wherein the angle sum, groove depth and groove width are selected such that upon enhanced contraction deformation of the container in the center axis direction, upper and lower edges of the circumferential groove are brought into contact with each other to preserve buckling strength and pressure reduction resistance.

* * * * *